United States Patent [19]

Chung

[11] Patent Number: 4,607,847

[45] Date of Patent: Aug. 26, 1986

[54] GAME AND APPARATUS THEREFOR

[76] Inventor: W. Reginald Chung, 1402 Murray Ave., Tifton, Ga. 31794

[21] Appl. No.: 683,855

[22] Filed: Dec. 20, 1984

[51] Int. Cl.[4] ..... A63F 3/00

[52] U.S. Cl. ..... 273/264; 273/284

[58] Field of Search ..... 273/258, 260, 261, 264, 273/271, 284, 285, 286

[56] References Cited

U.S. PATENT DOCUMENTS

| | | | |
|---|---|---|---|
| 895,875 | 8/1908 | Mercer | 273/284 |
| 1,555,937 | 10/1925 | Billman | 273/261 |
| 1,564,746 | 12/1925 | Barnard | 273/271 |
| 1,674,533 | 6/1928 | Templeton | 273/284 |
| 3,531,122 | 9/1970 | Peebles | 273/284 X |
| 3,609,886 | 10/1971 | Vien | 434/99 |
| 4,138,120 | 2/1979 | Daitzman | 273/271 |
| 4,468,036 | 8/1984 | Istrati | 273/271 |

FOREIGN PATENT DOCUMENTS

| | | | |
|---|---|---|---|
| 2654115 | 6/1977 | Fed. Rep. of Germany | 273/260 |

OTHER PUBLICATIONS

Stephen Krulik, "Problems, Problem Solving, and Strategy Games", pp. 649–652 of Nov. 1977 Mathematics Teacher.

*Primary Examiner*—Harland S. Skogquist
*Attorney, Agent, or Firm*—James B. Middleton

[57] ABSTRACT

A game derived from tick-tack-toe, and a gameboard and game pieces for playing the game. The gameboard is square, with a grid of sixteen square locations to receive game pieces. For two players, a cover is placed over seven of the locations to leave a grid of nine, and for three or four players all sixteen locations are used. The game pieces are octagonal and are placed for movement along the grid or diagonally to the grid. Pieces are placed in turn to attempt to place three in a contiguous line. When all pieces have been placed and no player has won, the pieces are moved within the grid in an effort to win. A piece must be moved in the direction set when the piece was placed, but the piece can be changed during a move, or the direction can be changed as one player's turn.

5 Claims, 4 Drawing Figures

GAME AND APPARATUS THEREFOR

INFORMATION DISCLOSURE STATEMENT

The game of crisscross, or tick-tack-toe, has been the basis for numerous forms of apparatus to play tick-tack-toe or some variation of that game. The usual form of the game requires that players successively place game pieces into predetermined locations in an effort to place, usually, three pieces in a line. The player who succeeds in this is the winner.

One problem with the tick-tack-toe games is that pieces are placed, and the game is over very quickly. Also, with two reasonably sophisticated players, each player is so successful at blocking the other that it is very difficult for either player to win a game.

Previous efforts to devise a game based on tick-tack-toe have resulted in elaborate apparatus with complex rules, or simple apparatus that retains the shortcomings of the basic game.

SUMMARY OF THE INVENTION

This invention relates generally to a game apparatus, and is more specifically concerned with a game derived from the game of tick-tack-toe, for two or more players.

The present invention provides a gameboard having a plurality of predetermined locations arranged in a grid. Each player has a plurality of game pieces that are unique to that player, all game pieces being receivable within each of the predetermined locations in either a first position or a second position. The two positions of the game pieces determine the two possibilities for subsequent movement of the game piece within the grid.

In playing the game of the present invention, the players successively place one of their game pieces in a location. Each player attempts to place (for example) three pieces in a line, while other players attempt to block such efforts. When all players have placed all their pieces, if no player has won the game, the game continues with the players successively moving their pieces in an effort to achieve the winning line. The game pieces contain indicia for indicating the position of the piece, and the position determines the allowed direction of motion of the piece within the grid. The position of the piece, hence the allowed direction of motion, can be changed by a player during that player's turn, or as a player's turn.

BRIEF DESCRIPTION OF THE DRAWINGS

These and other features and advantages of the present invention will becomes apparent from consideration of the following specification when taken in conjunction with the accompanying drawings in which.

DETAILED DESCRIPTION OF THE EMBODIMENTS

Figure 1:
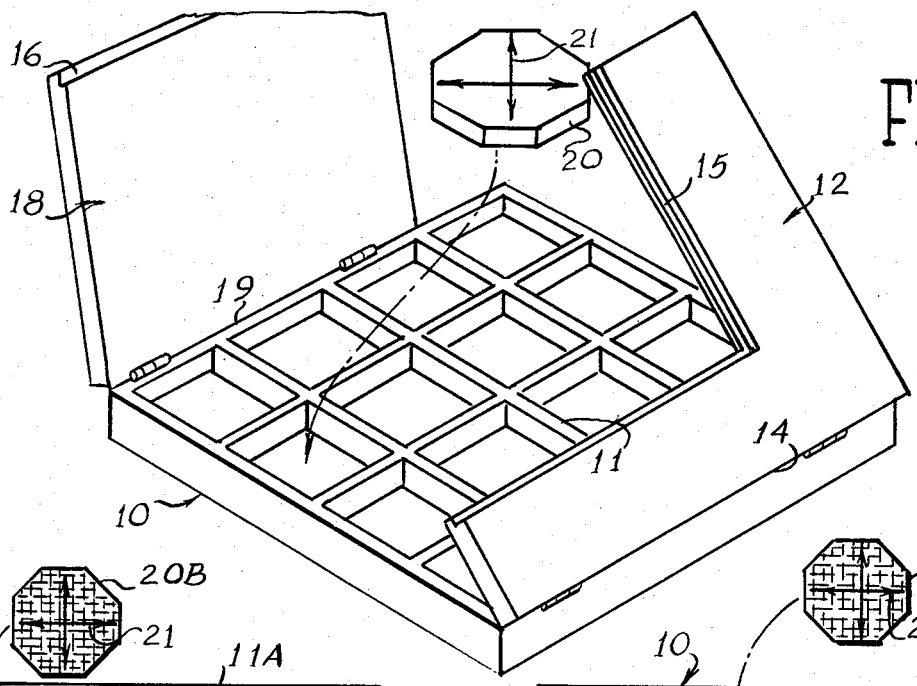
FIG. 1 is a perspective view of a game apparatus made in accordance with the present invention, showing one game piece exploded therefrom.

Referring now more particularly to the drawings, and to those embodiments of the invention here presented by way of illustration, FIG. 1 shows the preferred arrangement for apparatus made in accordance with the present invention. In FIG. 1 it will be seen that there is a gameboard generally designated at 10 having a grid 11 on the gameboard defining a plurality of locations, or squares, within the grid 11.

The gameboard is provided with a pair of cover members, one cover member 12 being hinged along an edge 14 for pivotal motion with respect to the gameboard 10. It will be seen that the cover member 12 is L-shaped, and is of such size as to cover a row of squares and a column of squares of the grid 11. As shown in FIG. 1, the grid 11 includes four rows and four columns of squares for a total of sixteen squares. As a result, when the cover member 12 is pivoted to cover a portion of the grid 11, the portion of the grid 11 remaining uncovered will comprise nine squares.

It will be seen that the cover member 12 is provided with a lip 15 along the inner edges. This lip 15 cooperates with a mating lip 16 on the cover member 18. It will be seen that the cover member 18 is hinged at an edge 19 to the gameboard 10; therefore, the cover member 18 can be pivoted with respect to the gameboard 10 and cover the remaining nine squares of the grid.

From the foregoing description, it will be understood that the cover members 12 and 18 can be placed over the grid 11 to completely enclose the grid 11. The cover member 18 can be opened to expose nine squares to allow two players to play a game, and the remaining cover portion 12 can be pivoted to uncover the remaining seven squares to allow three or four players to play the game.

It will be seen that there is a game piece shown at 20, the game piece 20 being such as to be received within any one of the squares of the grid 11. It will therefore be understood that, for transporting the game, a required number of game pieces 20 can be received within the squares of the grid 11, the cover members 12 and 18 can be placed over the grid, and the entire game is unitized for easy transport.

Figure 2:
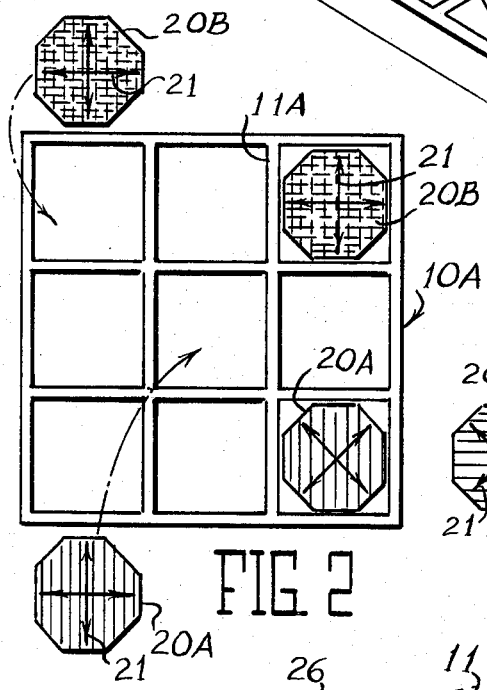
FIG. 2 is a top plan view of a gameboard, or grid, for use by two players, and showing some game pieces in conjunction therewith.

Looking now at FIG. 2 of the drawings, there is a gameboard designated at 10A. While the gameboard 10A is substantially the same as the gameboard 10, the entire gameboard includes only the nine squares, and the covers have been omitted. The game as shown in FIG. 2 is a very simple version of the same game, but lacking the versatility in that only two players can reasonably play the game. The gameboard 10A includes a grid 11A defining nine squares. The game pieces are designated at 20A and 20B, the pieces 20A being unique to one player while the pieces 20B are unique to the other player.

The game pieces 20A and 20B are designed so that any game piece 20A or 20B can be received within any one of the squares defined by the grid 11A. Furthermore, any game piece 20A or 20B can be received within any square in either of two different rotational positions. It will be noted that each of the game pieces includes position indicating means designated at 21, the indicating means 21 being here shown as crossed arrows.

While those skilled in the art will devise numerous forms of game pieces, the game pieces here illustrated are regular octagons, the arrows of the indicating means 21 being perpendicular to opposite, parallel sides of the octagon. Also, while many variations may be devised for rendering game pieces 20A and 20B unique, the means here indicated is by coloring the different game pieces individually. As here illustrated, the game pieces 20A are red and the game pieces 20B are yellow. Apart from the color, the game pieces 20A and 20B are precisely alike so any game piece can be received within any square of the grid 11A.

The game as illustrated in FIG. 2 of the drawings, having nine squares, is substantially equivalent to the conventional game tick-tack-toe, and the beginning of the present game is played by substantially the same rules. Rather than having two different shapes of game piece, or markers, each player has a different color of game piece. The players take turns laying a game piece 20A or 20B into a square of the grid 11A, each player attempting to place three game pieces in a contiguous line. Of course, the opposite player attempts to block the first player, so it is possible that neither player will achieve a contiguous line of three game pieces. After all game pieces are laid, if there is no winner the game pieces are moved within the grid in accordance with rules to be discussed hereinafter.

Figure 3:
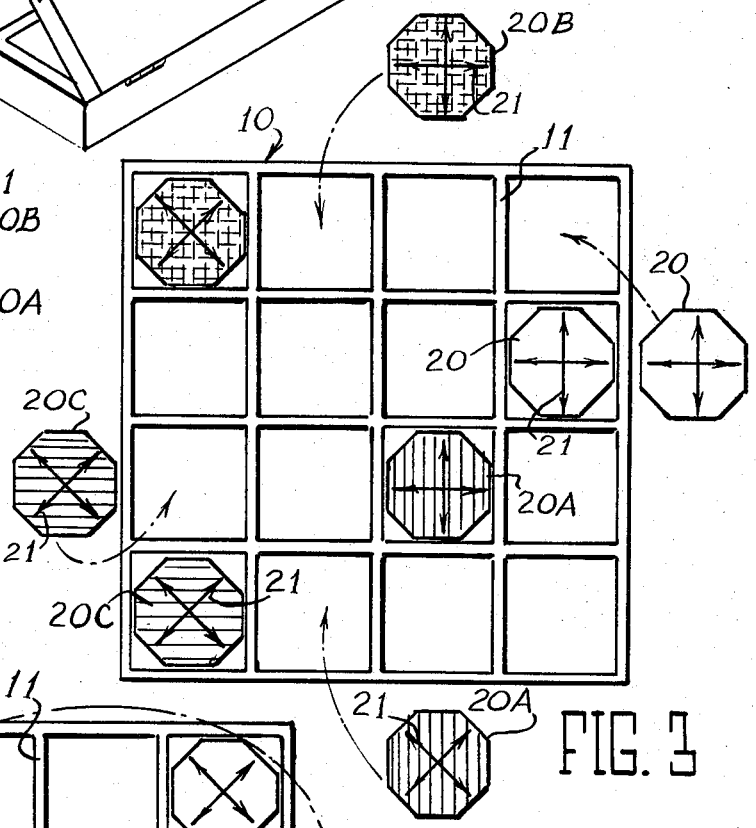
FIG. 3 is a view similar to FIG. 2, but showing a gameboard for use by 3 or 4 players; and, FIG. 4 is a view similar to FIG. 3, but showing game pieces for four players, and illustrating the continuation of the game after all pieces have been laid.

Looking now at FIG. 3 of the drawings, it will be seen that there is a gameboard indicated at 10, it being understood that the gameboard shown in FIG. 3 is the same as the gameboard shown in FIG. 1 except that the cover pieces 12 and 18 are omitted. The gameboard 10 also includes the grid 11 which defines sixteen squares.

Since the gameboard 10 is useable by four players, there are four unique game pieces indicated at 20, 20A, 20B and 20C. The game piece 20 shown in FIG. 1 is uncolored, or white, so the game pieces 20 in FIG. 3 are also white. The game pieces 20A and 20B are the red and yellow pieces as were discussed in conjunction with FIG. 2; and, an additional game piece 20C is indicated as colored blue.

With this description, it will be understood that the game shown in FIG. 3 is played in the same manner as has been previously discussed, the players successively placing one game piece into a selected square of the grid 11. It is the object for a player to place three of his game pieces in a contiguous line while the other players attempt to block a player to prevent that player from winning.

Figure 4:
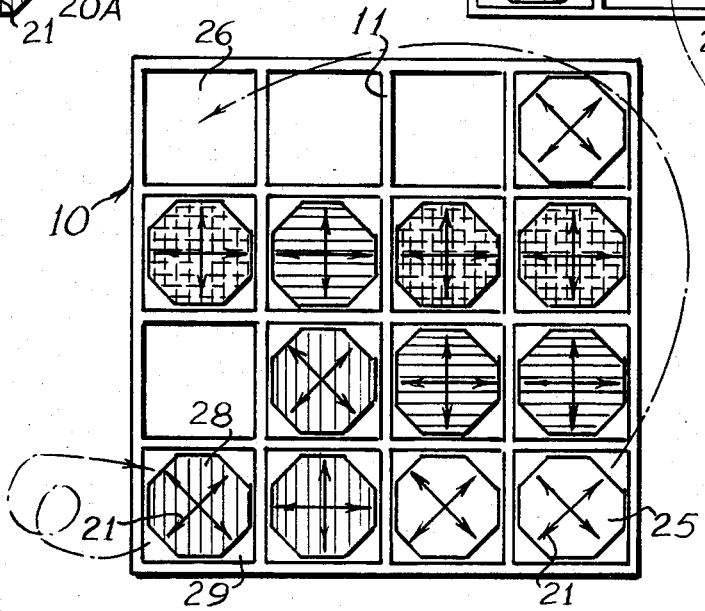

With the above in mind, attention is directed to FIG. 4 of the drawings which shows the gameboard 10 with grid 11, and having three game pieces of each of four players placed within the grid 11, but with no game piece achieving a contiguous line of three game pieces. It will be understood that, in the conventional tick-tack-toe game, the game would end at this point and no player would be declared the winner. In the present game however the game continues, each player continuing to try to become a winner.

Since all of the game pieces 20, 20A, 20B and 20C are placed within a square on the gameboard 10, the game pieces can be moved only from one location to another in an effort to win the game. Furthermore, since the game pieces of the present invention are placed both as to location within the grid 11 and with respect to the rotational position of the game piece, either aspect of positioning a game piece may be important.

In FIG. 4 of the drawings, it will be seen that the white game piece 25 is on the gameboard with the indicating means 21 pointing diagonally. This means that the game piece 25 can be moved only diagonally of the gameboard 10. If the player having the white game pieces wishes to move the game piece 25, the piece 25 must be moved to the square designated at 26. The red game piece 28 also has the indicating means 21 pointing diagonally, so this game piece can be moved only diagonally; however, it will be noted that there is no vacant space in the diagonal of the gameboard. As an alternative, the player having the red pieces may elect to take his turn by removing the game piece 28, rotating the game piece so that the indicating means 21 points along the grid, and replace the game piece 28 into the square 29. Thus, the player has had his turn, and has varied his position in the game, but has left the game piece 28 in the same square 29 as before his turn. While the player makes little progress on this turn, the player can make a physical move along the grid 11 on his next turn at the game.

Following these simple rules, it will be understood that the players can move the various game pieces within the grid 11 until one player achieves a contiguous line of three of his unique game pieces. It is contemplated that any straight line of three contiguous squares will constitute a win.

In beginning a game of the present invention, it is contemplated that some chance means will be used to determine which player begins, and successive players will take their turns in rotational order following the player who is first. The chance means might well take the form of a die, though other well known devices may be used. It will also be understood that, when four players are playing the game, the players may be divided into teams so that two players cooperate to achieve one winning line of one color game piece, while blocking the other two players and the other two colors of game pieces.

It will therefore be understood that the present invention provides a game apparatus that is simple and easy to learn, being based on the familiar game of tick-tack-toe, but the game adds several extra dimensions to appeal to more sophisticated players. The game has the very familiar aspect of simply placing the game pieces in the grid, but then continues in the aspect of shifting the game pieces in a further effort for one player to win. The tension of the first aspect of the game is increased because the placement of the game pieces during the first aspect of the game has a great effect on the second aspect of the game. As a result, long term strategy is beneficial and renders the game more exciting.

While regular octagonal game pieces have been disclosed, it will be readily understood that other shapes that allow the variation in rotational position will function as well. Other changes will suggest themselves to those skilled in the art, so it will be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. A game apparatus for playing a game such as tick-tack-toe, said game apparatus including a gameboard, a grid on said gameboard, said grid dividing said gameboard into a plurality of locations arranged in columns and rows, said grid being suitable for playing a game using fewer than all said locations, said game apparatus including a plurality of game pieces receivable within said grid, and cover means for selectively covering said grid, said cover means including a first cover means hinged to one side of said gameboard for selectively covering one column and one row of said grid, and a second cover means hinged to another side of said game board for selectively covering the remainder of said grid.

2. A game apparatus as claimed in claim 1, said game pieces being shaped to be received in said locations selectively in a first rotational position, and in a second rotational position forty-five degrees from said first rotational position.

3. A game apparatus as claimed in claim 2, and further including position indicating means on each of said game pieces for indicating the rotational position of said game piece.

4. A game apparatus as claimed in claim 3, said plurality of game pieces being divided into four sets of said game pieces, each set of game pieces having the game pieces therein colored a unique color for defining said sets of game pieces.

5. A game apparatus as claimed in claim 4, each game piece of said plurality of game pieces being shaped as a regular octagon, said position indicating means comprising at least one arrow perpendicular to one side of said octagon.

* * * * *